US010677422B2

(12) United States Patent
Meng

(10) Patent No.: US 10,677,422 B2
(45) Date of Patent: Jun. 9, 2020

(54) DECORATIVE LIGHT FILTER

(71) Applicant: James Meng, Ballwin, MO (US)

(72) Inventor: James Meng, Ballwin, MO (US)

( * ) Notice: Subject to any disclaimer, the term of this patent is extended or adjusted under 35 U.S.C. 154(b) by 0 days.

(21) Appl. No.: 16/046,951

(22) Filed: Jul. 26, 2018

(65) Prior Publication Data

US 2019/0032889 A1 Jan. 31, 2019

Related U.S. Application Data

(60) Provisional application No. 62/537,389, filed on Jul. 26, 2017.

(51) Int. Cl.

| | |
|---|---|
| ***F21V 9/08*** | (2018.01) |
| ***F21V 17/10*** | (2006.01) |
| ***F21V 17/08*** | (2006.01) |
| ***F21W 131/10*** | (2006.01) |
| ***F21W 131/109*** | (2006.01) |
| ***F21W 121/00*** | (2006.01) |

(52) U.S. Cl.

CPC ..... *F21V 9/08* (2013.01); *F21V 17/08* (2013.01); *F21V 17/10* (2013.01); *F21W 2121/00* (2013.01); *F21W 2131/10* (2013.01); *F21W 2131/109* (2013.01)

(58) Field of Classification Search

CPC ..... F21V 9/08; F21V 17/10; F21V 17/08; F21W 2121/00; F21W 2131/109; F21W 2131/10

See application file for complete search history.

(56) References Cited

U.S. PATENT DOCUMENTS

| | | | | |
|---|---|---|---|---|
| 2,326,004 | A * | 8/1943 | Barrett | F21K 5/02 359/359 |
| 5,143,443 | A | 9/1992 | Madsen | |
| 5,222,802 | A | 6/1993 | Beck | |
| 5,311,409 | A * | 5/1994 | King | G03B 15/06 362/17 |
| 6,176,595 | B1 | 1/2001 | Bomas | |
| 6,902,297 | B1 | 6/2005 | Fung | |
| 7,018,067 | B2 * | 3/2006 | Wu | F21S 4/22 362/227 |
| 7,048,414 | B2 | 5/2006 | Weber | |
| 7,399,097 | B1 * | 7/2008 | DeLaPaz | G03B 15/02 362/17 |
| 2006/0109641 | A1 * | 5/2006 | Fong | G03B 15/02 362/16 |
| 2006/0291217 | A1 * | 12/2006 | Vanderschuit | A63H 27/10 362/363 |
| 2008/0175005 | A1 * | 7/2008 | Kellmann | F21V 3/023 362/352 |
| 2008/0259613 | A1 | 10/2008 | Blake | |
| 2008/0310140 | A1 * | 12/2008 | Capozzi | G03B 15/02 362/16 |

* cited by examiner

*Primary Examiner* — Joseph L Williams
*Assistant Examiner* — Jose M Diaz
(74) *Attorney, Agent, or Firm* — Charles Runyan

(57) ABSTRACT

A decorative filter is disclosed. Quick, convenient, and festive update to garden lights and outdoor fixtures. The filter has a bag-like structure to facilitate placing it over a landscaping light fixture to change the color of the light that projects from the fixture. The filter is sheet-like and can be a gel or other color filter. Sometimes the filter is made from a polymeric material.

20 Claims, 5 Drawing Sheets

DECORATIVE LIGHT FILTER

CROSS REFERENCE TO RELATED APPLICATION

The present application is related to and claims priority to U.S. Provisional Patent Application No. 62/537,389 filed Jul. 26, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of outdoor light fixtures and more specifically relates to outdoor light fixtures, such as low-voltage lights.

2. Description of Related Art

People are always looking for ways to enhance the look of their home and yard. Some people may illuminate their property with garden lights and outdoor fixtures. However, the bulbs in such lights are typically white and cannot be changed to accommodate holidays and other celebrations. Other people may hang strands of colored lights, but this can be extremely time consuming and frustrating for lights that can only be displayed for a month or two at a time before needing to be swapped out. A suitable solution is desired.

U.S. Pat/Pub. No. 2008/0259613 A1 to Blake et al. relates to colored outdoor low voltage lighting covers, lenses, or colored fixture covers. The described colored outdoor low voltage lighting covers, lenses, or colored fixture covers include a method for altering a color of a light source. And includes the acts of covering at least a portion of a light source with a flexible, colored material, and removably affixing the flexible, colored material adjacent the light source to alter the color of the light output from the light source.

BRIEF SUMMARY OF THE INVENTION

In view of the foregoing disadvantages inherent in the known outdoor light fixtures art, the present disclosure provides a novel decorative light filter. Outdoor lighting refers to the use of outdoor illumination of private gardens and public landscapes, for the enhancement and purposes of safety, nighttime aesthetics, accessibility, security, recreation and sports, and social and event uses. The general purpose of the present disclosure, which will be described subsequently in greater detail, is to provide a quick, convenient, and festive update to garden lights and outdoor fixtures. This allows friends and family to temporarily decorate for celebrations, holidays, parties, cookouts, sporting events, and more. This further eliminates the need to replace all light fixtures with expensive color-changing led lights. It alleviates the hassle of hanging colored lights for holidays and subsequently taking them down a month or two later. It saves homeowners a considerable amount of time and frustration. The present invention instantly improves the curb appeal of a person's home and spruces up patios and pathway with splashes of color.

A decorative filter is disclosed herein. The decorative filter includes a hingeless, colored assembly that may have a terminal, closed end intersecting an axis; and a wall portion extending from the closed end along the axis to an edge that defines an opening spaced from the closed end, wherein the wall portion and closed end define an interior volume, the assembly exhibits a self-supporting structure, and the opening may be configured to receive an electric light fixture into the interior volume.

A method of using a decorative filter is also disclosed herein. The method of using a decorative filter may comprise the steps of: providing a decorative filter; providing a light fixture; and installing the decorative filter onto the light fixture. The decorative filter may have in some versions and axis. The filter comprises a hingeless, colored assembly that may have a terminal closed end intersecting the axis; and a wall portion extending from the closed end along the axis to an edge that defines an opening spaced from the closed end, wherein the wall portion and closed end define an interior volume. The assembly exhibits a self-supporting structure, and the opening may be configured to receive an electric light fixture into the interior volume For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a Decorative Light Filter, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an outdoor light fixture and more particularly to a decorative light filter as used to improve the outdoor light fixture, such as a low voltage light.

Generally, decorative filters (Celebration Gel Bags), such as disclosed in this document, change the color of an outdoor light in an instant—selected and remove perfect for celebrations, holidays, or to simply enhance the look of a yard. These bags can also be used to temporally light up yard trees, light garden paths and patio lights for special events. They can also be used commercially to attract attention, to promote sports teams, or on buildings hosting civic events such as events to enhance temperance, to attract civic attention, and to show support for police.

This innovative product may comprise a reusable, weatherproof, bag-like cover, made from colored gel paper or other suitable material. Gel paper is a thin sheet of transparent colored material, like polycarbonate or polyester. The cover can optionally include a securing strap, such as a flexible band, elastic, or drawstring, to secure the cover in place once and to prevent accidental removal. In use, users can simply pull the cover down over a light and secure the strap, elastic, or drawstring. To remove or swap out the cover, users can simply loosen the strap, elastic, or drawstring and pull up on the cover to remove.

Figure 1:
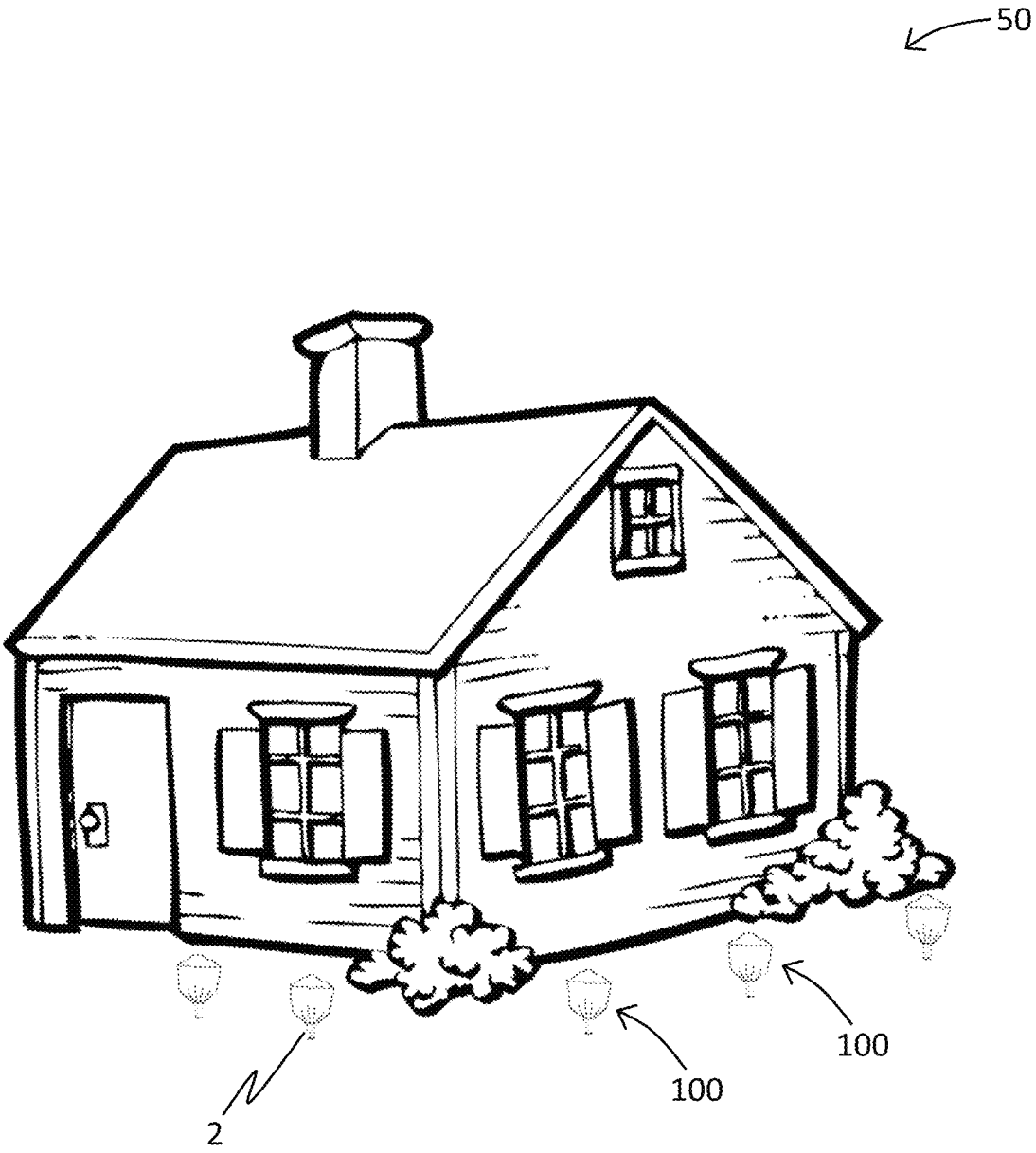
FIG. 1 is a perspective view of the decorative filter during an 'in-use' condition, according to an embodiment of the disclosure.

Referring now more specifically to the drawings by numerals of reference, there is shown in FIGS. 1-4, various views of a decorative filter 100. FIG. 1 shows a decorative filter 100 during an 'in-use' condition 50, according to an embodiment of the present disclosure.

Figure 2:
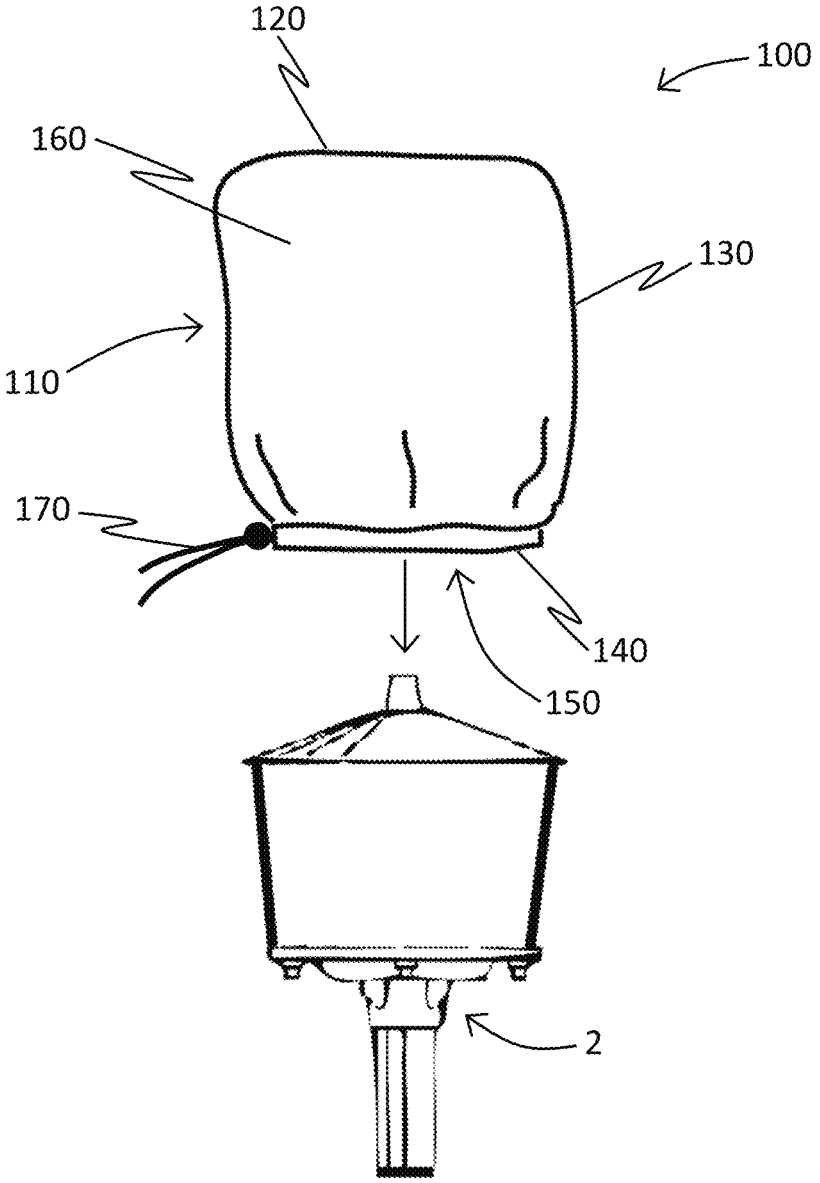
FIG. 2 is a perspective view of the decorative filter of FIG. 1, according to an embodiment of the present disclosure.

FIG. 2 shows a perspective view of the decorative filter 100 of FIG. 1, according to an embodiment of the present disclosure. As illustrated, the decorative filter 100 may include an assembly 110, a closed end 120, a wall portion 130, an edge 140, an opening 150, an interior volume 160, and a closure device 170. A hingeless, colored assembly 110 may have a terminal closed end 120 intersecting an axis; and a wall portion 130 extending from the closed end 120 along the axis to an edge 140 that defines an opening 150 spaced from the closed end 120, wherein the wall portion 130 and closed end 120 define an interior volume 160. The assembly 110 exhibits a self-supporting structure. And the opening 150 may be configured to receive an electric light fixture 2 into the interior volume 160. The assembly 110 may be configured to fit loosely around and substantially surround the electric light fixture 2. For purposes of this disclosure, the phrase "fit loosely around" means that the assembly 110 has gaps between itself and the electric light fixture 2; it is not form fit around the electric light fixture. For purposes of this disclosure the phrase "substantially surround the electric light fixture" means that the assembly 110 surrounds the electric light fixture 2 to a sufficient extent on sufficient sides to color the projected light. The assembly 110 comprises light-transmissive, alternatively transparent, and alternatively translucent material. And assembly 110 comprises a closure device 170 disposed on the wall portion 130 adjacent to the opening 150; the closure device 170 comprises an elastic string 172 (elastic band), alternatively a drawstring 174 and alternatively a flexible band 176. The assembly 110 may be formed from a sheet-like material.

An axis is defined as running through the bag intersecting the closed end 120 but not intersecting the wall portion 130. The decorative filter can have a shape selected from a bag shape, an envelope shape, a geometric prism shape, and a cylinder. For purposes of this disclosure, a bag shape is somewhat cylindrical like the shape of a paper bag or plastic trash bag. Similarly, an envelope shape is like the shape of a plastic trash bag in that the closed end is sealed flat with the open end opposite the closed end. "Geometric prism" carries its normal definition. If the decorative filter were to have four sides for the walls, that would give four corners running along the axis and four windows between the four corners from which light could project.

The term "self-supporting structure" is defined as a structure that neither has or needs additional internal or external supports to substantially maintain its shape.

Gels or color filters are typically a colored flat sheet of a film-like or sheet-like material designed to change the color of light or projected light. The sheet-like material comprises polymeric material, the polymeric material comprises any one or any combination of polyesters, polycarbonates, silicones, polyethylenes, polypropylenes, and acrylates. Gels, their construction, their material, their usage, etc. are well known.

There are no electrical or mechanical connectors between the filter and the light source and alternatively between the filter and the light fixture and the assembly 110 does not contain a seam with a closure mechanism aligned along the axis.

Figure 3:
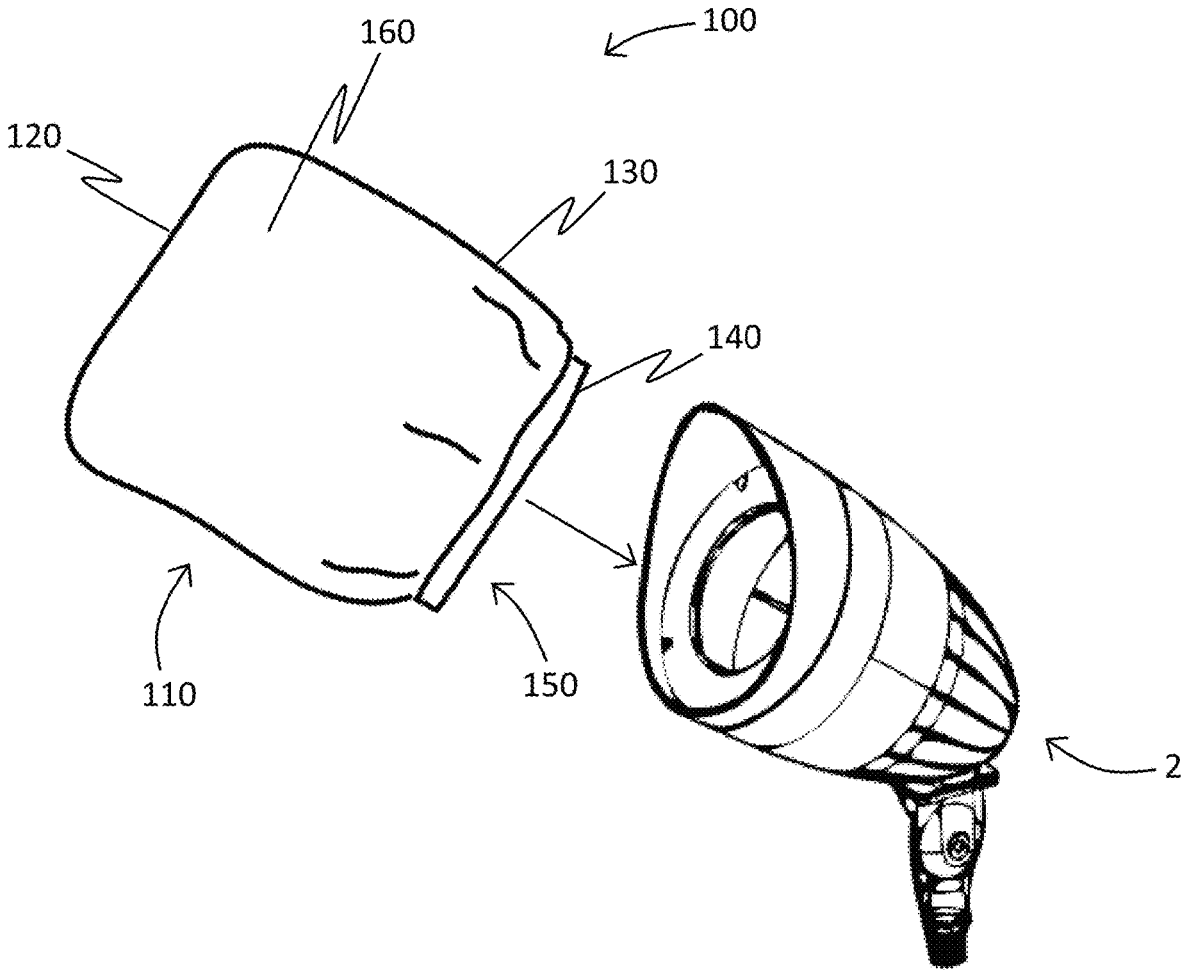
FIG. 3 is a perspective view of the decorative filter of FIG. 1, according to an embodiment of the present disclosure.

FIG. 3 shows a perspective view of a decorative filter according to another embodiment of the present disclosure. As above, the decorative filter 100 may include an assembly 110, a closed end 120, a wall portion 130, an edge 140, an opening 150, an interior volume 160, and a closure device 170. In this embodiment, the decorative filter 100 is depicted with a spot-light-type electrical light fixture.

Figure 4:
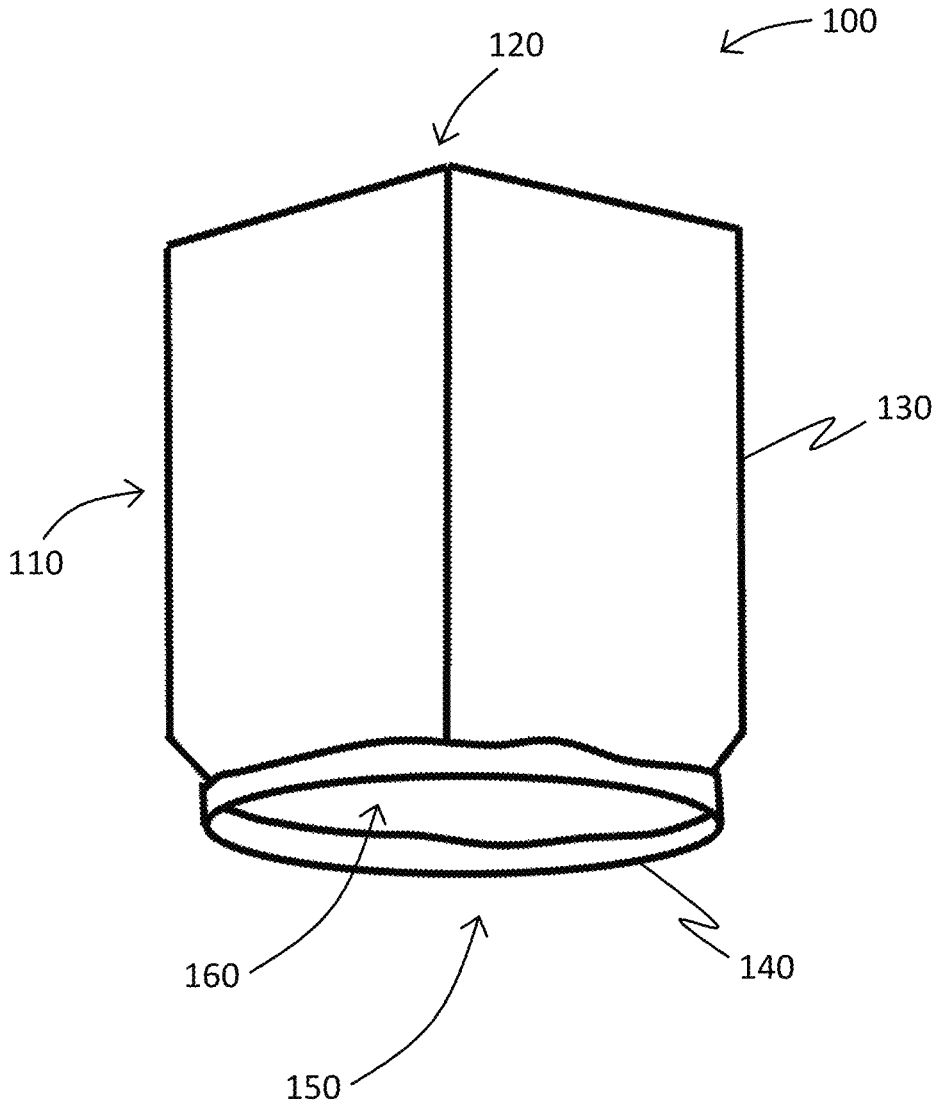
FIG. 4 is a perspective view of the decorative filter of another embodiment of the present disclosure.

FIG. 4 shows a perspective view of a decorative filter according to another embodiment of the present disclosure. As above, the decorative filter 100 may include an assembly 110, a closed end 120, a wall portion 130, an edge 140, an opening 150, an interior volume 160, and a closure device 170. In this embodiment, the wall portion 130 has four sides and four edges or corners.

Figure 5:
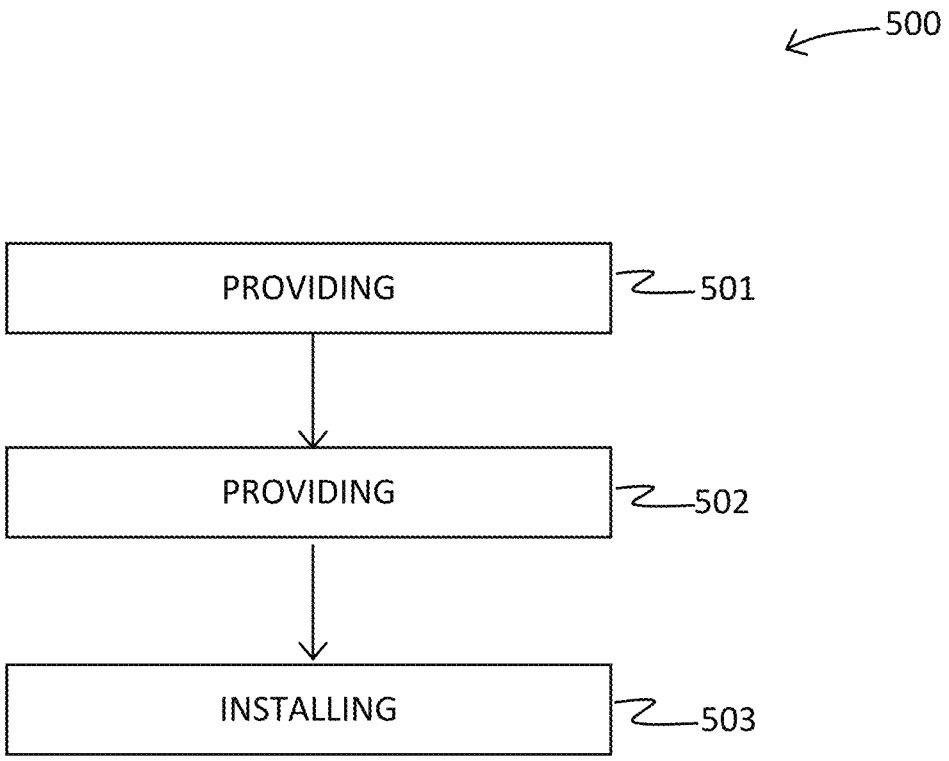
FIG. 5 is a flow diagram illustrating a method of use for the decorative filter, according to an embodiment of the present disclosure.

FIG. 5 is a flow diagram 550 illustrating a landscaping method 500, according to an embodiment of the present disclosure. As illustrated, the landscaping method 500 may include the steps of providing 501 a decorative filter 100; providing 502 a light fixture 2; and installing 503 the decorative filter 100 on the light fixture 2. Decorative filter 100 may have an axis in which the filter 100 comprises a hingeless, colored assembly 110 that may have a terminal closed end 120 intersecting an axis, and a wall portion 130 extending from the closed end along the axis to an edge 140 that defines an opening 150 spaced from the closed end 120, wherein the wall portion 130 and closed end 120 define an interior volume 160, the assembly 110 exhibits a self-supporting structure, and the opening 150 may be configured to receive an electric light fixture into the interior volume 160.

Some versions of decorative filter 100 are recommended for exterior use.

Those with ordinary skill in the art will now appreciate that upon reading this specification and by their understanding the art of decorative light filters as described herein, methods of using the filters will be understood by those knowledgeable in such art.

The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the decorative filter 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A decorative filter having an axis, the filter comprising:

a hingeless, colored assembly having a terminal closed end intersecting the axis;

a wall portion extending from the closed end along the axis to an edge that defines an opening spaced from the closed end;

a cavity circumscribing the end of the hingeless, colored assembly; and a fastener band circumscribing the terminal end of the hingeless, colored assembly, the fastener band being contained within the cavity, the fastener band being mechanically separated from and non-integral to the hingeless, colored assembly;

wherein the assembly comprises a gel and alternatively, gel paper;

wherein the wall portion and closed end define an interior volume, the assembly exhibits a self-supporting structure, and the opening is configured to receive an electric light fixture into the interior volume.

2. The decorative filter of claim 1 wherein the assembly is configured to fit loosely around and substantially surround the electric light fixture.

3. The decorative filter of claim 2 wherein the assembly comprises any one or any combination of light-transmissive, transparent, and translucent material.

4. The decorative filter of claim 1 wherein the assembly is formed from a sheet-like material.

5. The decorative filter of claim 4 wherein the assembly has a shape selected from a bag shape, an envelope shape, a geometric prism shape, and a cylinder shape.

6. The decorative filter of claim 5 wherein the sheet-like material comprises polymeric material.

7. The decorative filter of claim 6 wherein the polymeric material comprises any one or any combination of polyesters, polycarbonates, silicones, polyethylenes, polypropylenes, and acrylates.

8. The decorative filter of claim 7 in which there are no electrical or mechanical connectors between the filter and the light source or between the filter and the light fixture.

9. The decorative filter of claim 8 in which the assembly does not contain a seam with a closure mechanism aligned along the axis.

10. The decorative filter of claim 2 wherein the assembly is formed from a sheet-like material.

11. The decorative filter of claim 10 wherein the assembly has a shape selected from a bag shape, an envelope shape, a geometric prism shape, and a cylinder shape.

12. The decorative filter of claim 11 wherein the sheet-like material comprises polymeric material.

13. The decorative filter of claim 12 in which there are no electrical or mechanical connectors between the filter and the light source or between the filter and the light fixture.

14. The decorative filter of claim 13 in which the assembly does not contain a seam with a closure mechanism aligned along the axis.

15. A decorative filter comprising:

a hingeless, colored assembly having a terminal closed end intersecting an axis;

a wall portion extending from the closed end along the axis to an edge that defines an opening spaced from the closed end;

a cavity circumscribing the end of the hingeless, colored assembly; and a fastener band circumscribing the terminal end of the hingeless, colored assembly, the fastener band being contained within the cavity, the fastener band being mechanically separated from and non-integral to the hingeless, colored assembly;

wherein the wall portion and closed end define an interior volume;

the assembly exhibits a self-supporting structure and is formed from a sheet-like material in a shape selected from a bag shape, an envelope shape, a geometric prism shape, and a cylinder shape;

the sheet-like material comprises any one or any combination of polyesters, polycarbonates, silicones, polyethylenes, polypropylenes, and acrylates;

the opening is configured to receive an electric light fixture into the interior volume;

the assembly is configured to fit loosely around and substantially surround the electric light fixture;

and the assembly further comprises any one or any combination of light-transmissive, transparent, and translucent material.

16. A method of landscaping comprising:

providing the decorative filter of claim 15;

providing a light fixture; and installing the decorative filter on the light fixture.

17. A method of landscaping comprising:

providing the decorative filter of claim 1;

providing a light fixture; and installing the decorative filter on the light fixture.

18. The decorative filter of claim 1, wherein the fastener comprises an elastic string.

19. The decorative filter of claim 1, wherein the fastener comprises a drawstring, and the cavity further comprises at least one aperture enabling the drawstring to exit the cavity and be fastened by a user externally to the cavity.

20. The decorative filter of claim 1, wherein the fastener comprises a flexible band.

* * * * *